US005967770A

United States Patent [19]

Heine et al.

[11] Patent Number: 5,967,770

[45] Date of Patent: Oct. 19, 1999

[54] DEVICE FOR CONTINUOUS THERMAL TREATMENT OF MULTIDIMENSIONAL SHEET STRUCTURES CONSISTING OF FIBERS MADE OF POLYACRYLONITRILE

[75] Inventors: Michael Heine, Allmanshofen; Dieter Kompalik, Rüsselsheim, both of Germany

[73] Assignee: SGL Technik GmbH, Germany

[21] Appl. No.: 08/893,396

[22] Filed: Jul. 11, 1997

Related U.S. Application Data

[62] Division of application No. 08/645,832, May 14, 1996, abandoned.

[30] Foreign Application Priority Data

May 16, 1995 [DE] Germany ..... 195 17 911

[51] Int. Cl.[6] ..... F27B 9/28

[52] U.S. Cl. ..... 432/59; 432/8

[58] Field of Search ..... 432/59, 8

[56] References Cited

U.S. PATENT DOCUMENTS

| | | | |
|---|---|---|---|
| 2,319,300 | 5/1943 | Cook | 432/59 |
| 2,319,302 | 5/1943 | Cook | 432/59 |
| 3,412,062 | 11/1968 | Johnson et al. | 523/440 |
| 3,961,888 | 6/1976 | Riggs | 8/115.54 |
| 4,591,517 | 5/1986 | Whipple et al. | 432/59 |
| 4,789,332 | 12/1988 | Ramsey et al. | 432/59 |
| 4,790,749 | 12/1988 | Mauro | 432/59 |

FOREIGN PATENT DOCUMENTS 72 31 623 8/1972 Germany .

OTHER PUBLICATIONS

Fitzer, E., et al, *Carbon 13*:63–69 (1975) (Month Unknown).

*Primary Examiner*—Teresa Walberg
*Assistant Examiner*—Jiping Lu
*Attorney, Agent, or Firm*—Connolly Bove Lodge & Hutz

[57] ABSTRACT

A device for continuous thermal treatment of multidimensional sheet structures consisting of fibers (18) made of polyacrylonitrile or substantially polyacrylonitrile comprises a furnace (23) with chamber-like sections, through which sections the sheet structure is continuously moved on a gas permeable transport track (21). In each of the chamber-like sections there is a gas stream flowing through the sheet structure perpendicular to the sheet structure. In every section, devices measure the parameters of the gas stream temperature, pressure and gas flow above and below the sheet structure to control the operation of heating elements (26), fans (27) in the approach flow region, and fans (28) in the outflow regions of every section. These parameters are adjusted to predetermined values necessary for an effective and precise thermal treatment of the sheet structures (18).

6 Claims, 2 Drawing Sheets

DEVICE FOR CONTINUOUS THERMAL TREATMENT OF MULTIDIMENSIONAL SHEET STRUCTURES CONSISTING OF FIBERS MADE OF POLYACRYLONITRILE

CROSS-REFERENCE TO RELATED APPLICATION

This application is a division of application Ser. No. 08/645,832, filed May 14, 1996, now abandoned.

DESCRIPTION

The invention relates to equipment for carrying out a method for producing a multidimensional sheet structure, constructed from fibers consisting of carbon or mainly of carbon, from a starting material which consists of polyacrylonitrile or substantially of polyacrylonitrile.

Multidimensional sheet structures which consist mainly or completely of carbon and are constructed from fibres, such as woven fabrics, knitted fabrics, layered materials, felts or non-woven fabrics for example, which originate from organic polymers, such as cellulose, wool, synthetic resins, pitch or polyacrylonitrile for example, are used in the widest variety of fields. They are found, to name only a few examples, as flame retardant textiles in vehicle seats or work-protection means, as insulating material which can be used under protective gas up to the highest temperatures, as corrosion resistant filter material, as electrically conductive or insulating substrates, depending on their quality, or as starting materials for composite materials. A minimum requirement for the materials described here is that the fibres from which they are constructed have at some time been made infusible by thermal treatment, and that, moreover, despite the changes which have occurred in said materials, the fibrous structure has been retained. This thermal treatment is denoted oxidation or stabilization. It is carried out with the cooperation of oxidizing agents and should be controlled in such a way that the fibres of the textile structure which is used obtain certain properties. For reasons of rational production, it would be desirable to carry out this stabilization process on whole webs of material and to do so in a continuous operating manner. With some types, such as textile materials made of cellulose for example, this is now already possible. In the case of polyacrylonitrile (termed PAN in the following)—based multidimensional sheet structures constructed from fibres, it is not yet possible to carry out in an economic way stabilization of webs in continuous operation, and even the discontinuous stabilization of webs of material or pieces of material which are not very thin is problematic. Thermally stabilized polyacrylonitrile-based multidimensional sheet structures constructed from fibres are for this reason still produced by a comparatively expensive method, by first of all thermally stabilizing the PAN-fibres as such, i.e. making them infusible, and then processing the stabilized fibres further to form the various multidimensional sheet fibre structures. In order to do this in the case of felts, the thermally stabilized fibres first of all have to be crimped, then cut to form staple fibres and then in a final step, a felt has to be made from the staple fibres. Such a method is elaborate and expensive, because the PAN-fibres lose some of their textile properties during thermal stabilization and are then more difficult to process to form the various textile structures. The use of the method is necessary, however, because during thermal stabilization, strongly exothermic reactions occur in the fibre, and an adiabatic overheating of the fibres occurs because the removal of heat is hindered when stabilizing whole textile layers or webs, this resulting in melting or burning off of the fibres. These reactions, namely the dehydrogenation of the polymer under the action of oxidizing agents, in particular oxygen, its cyclization to form a heteroaromatic ladder polymer, and also further chemical cross-linkings and undesired but not completely suppressible unspecific oxidations of the polymer, occur in parallel (see e.g. E. Fitzer, D. J. Müller, Carbon, 13 (1975) p. 63–69), and can be influenced by process-control measures only to a very limited extent. However, even if the destruction of the fibre framework is successfully prevented, the fibres are damaged when there is non-optimal temperature control. Damage of this kind can, for example, be due to too strong an embrittlement or too great a take up of oxygen, resulting in high oxidation losses and consequently losses of quality in the subsequent carbonization step.

The underlying object of the invention was therefore to provide a method for directly converting multidimensional sheet structures consisting of polyacrylonitrile or substantially of polyacrylonitrile and constructed from fibres, such as woven fabrics, knitted fabrics, layered materials, felts, non-woven fabrics, for example, into the infusible non-carbonized form in one method step. In particular, the object consisted in providing a continuously operating method of this type, which offers the possibility of controlling precisely the reaction temperatures in the sheet structures as a function of the time. A further object was to make available a device or equipment with the aid of which it will be possible to carry out the method in accordance with the invention. Finally it was also an object of the invention to provide multidimensional sheet structures consisting of fibres which have been made infusible but which have not been carbonized, which multidimensional sheet structures have been produced using the new method.

The object is achieved by a method for producing a multidimensional sheet structure consisting of carbon or mainly of carbon and constructed from fibers, starting from a multidimensional sheet structure which consists of polyacrylonitrile or substantially of polyacrylonitrile and converting this multidimensional sheet structure into an infusible noncarbonized form while retaining the textile structure of the multidimensional sheet structure. The method includes flowing a gas, which is heated to temperatures in the range of 180 to 320° C. and which contains an oxygen-yielding substance through the multidimensional sheet structure for a period of at least 0.5 to 10 hours. The amount of gas flowing through the sheet structure is controlled in such a way that, on the one hand, the temperatures which are required for the operation of the chemical reactions which are necessary for the thermal stabilization of the polyacrylonitrile fibers or the fibers consisting substantially of polyacrylonitrile, are always maintained in the sheet structure, and on the other hand, in such a way that damaging overheating of these fibers in the sheet structure does not take place.

The following description and drawings also disclose a device or equipment for carrying out the method in accordance with the invention.

The term "infusible, non-carbonized form" of fibres or of multidimensional sheet structures consisting of fibres, which term is used in the claims and in the description, is synonymous with the term "thermally stabilized" or "stabilized" fibres or multidimensional sheet structures consisting of fibres, and has been used in order to differentiate clearly these stages of thermal treatment of the fibres or sheet structures from those stages which are reached at temperatures above 320° C. and which are designated as "partially carbonized", "carbonized" or "graphitized". The term "web of material" is also used in the following for the term "multidimensional sheet structure constructed from fibres", because of its shorter written form.

At the start of the stabilization process, so much heat must be supplied to the filaments in the web of material that the reactions which on stabilization take place are started. From the instant of the start onwards, the sum of the reaction enthalpies is strongly exothermal and the reactions would proceed with the melting or burning off of the web of material as a consequence if this were not prevented by the use of controlling measures. It is now the essential feature of the method in accordance with the invention that, during the whole thermal stabilization phase, which is characterized by the starting heat requirement and the exothermic range connected therewith, a gas or gas mixture, tempered in an appropriate way, flows through the multidimensional sheet structures or webs of material, which are constructed from PAN-fibres. As a result of this, such an amount of heat is transmitted to the fibres in the starting phase that the stabilization reactions start to occur. After this, the gas cools the fibres so much that the exothermic reactions occur whilst retaining the predetermined temperatures, and in the final phase, if the thermal development in the fibres decreases as a result of the reactions dying out, then heat is supplied again if necessary in order to maintain the desired reaction temperature and bring the stabilization quickly to an end. During the whole stabilization phase, the gas flowing through is also used as a medium for mass transport. It transports oxygen or oxygen carriers to the fibres and removes gaseous reaction products, such as $H_2O$, $CO_2$, CO or HCN for example, from the fibres. Because the mass transfers to and from the fibres occur in a diffusion-controlled manner, it is advantageous to work with comparatively high flow velocities in the web of material in order to achieve thin phase boundary surfaces on the fibres. This also meets the requirement for heat transfer conditions which are as good as possible.

In order to carry out successfully the method, it is important to detect exactly the temperatures prevailing in the web of material, which temperatures are in fact controlled variables for the gases which flow through the web of material and control the temperature therein. In discontinuous operation, this presents no difficulties. Arranged in the web of material can be thermoelements by means of which measurements and controls are carried out. The situation is different in the continuous manner of operation which is preferably used. Here, in order to adjust and maintain the temperatures in the web of material, an indirect method has to be used. This takes place as follows: in a discontinuously working test apparatus, in which an exact measurement of the temperature on the inside of the multidimensional sheet structures is possible, for example by means of thermoelements, then first of all, by varying the parameters, composition, temperature and flow velocity of the gas, the temperature range in which the desired quality of the multidimensional sheet structure consisting of fibres in the thermally stabilized state will be obtained is established. Afterwards, if still necessary, the dependent variables, such as the temperature and the flow velocity, and, if appropriate, the pressure of the through-flowing gas, which dependent variables are required in order to control the reaction correctly and economically, can be established by predetermining temperature paths which serve as reference variables and lie within the temperature range which was previously measured in the web of material. The apparatus for carrying out the tests mentioned is described at another point in this text. Those parameters established according to the above-described method, which parameters can also be easily measured and controlled in a continuously operating unit and by way of which the adjustment and maintaining of the desired temperature profile in the web of material is effected, are then transferred to the production unit. The monitoring and fine adjustment of the temperature of the web of material in this unit, if such should be necessary, can then take place, for example by measuring the temperature difference of gas flowing into the web of material and gas emerging therefrom or, in the case of thin webs of material, by measuring the surface temperature of the web of material. After the reactions involved in the stabilization have begun, the temperature path during stabilization can be isothermally controlled, falling from a certain temperature level or rising from such a temperature level. Combinations of the three types of temperature path mentioned can also be used where necessary.

An important parameter, which in particular influences the economic efficiency of the method, is the time required for the stabilization reaction. Naturally, attempts are always made to carry out this reaction in as short a time as possible. Because the stabilized webs of material which are produced have to have certain material characteristic values as a function of their later intended use, and these characteristic values as will be shown later are heavily dependent on the stabilization conditions, it is in many cases not possible to operate with the shortest possible time, i.e. with the highest possible temperature. An optimizing balancing of the quality demands, the temperature path and the time required for the stabilization reaction has to be made.

The widest variety of types of multidimensional sheet structures produced using PAN-fibres can be stabilized according to the method. In this connection, along with the thickness of the sheet structures—woven fabrics or non-woven fabrics having a thickness in the range of tenths of millimeters, to felts having thicknesses in the range of 10 cm and over can be stabilized—the differences also relate to the material composition (pure PAN or PAN with copolymers or additions), to the manner of producing the fibres and yarn (for example yarn produced from staple fibres or from filaments), or to the manner of producing the multidimensional sheet structure, such as weaving, knitting, knotting, warp knitting, felting, making random laid layers, and consequently to the fibre arrangement and the density or packing of the fibres in the structure. Seen in general terms, it is possible to thermally stabilize all multidimensional sheet structures constructed from PAN-fibres through which gas can flow.

Each of the qualities of sheet structures has its own stabilization characteristic and accordingly the manner of operation for each of these qualities has to be established by tests. The necessity for this procedure will be clarified by the following examples: a web of material, for example a felt, in which the fibres are arranged very close together, has a high density of energy during the reactions which occur during stabilization, its heat insulating capacity is very good and it is comparatively difficult for gases to flow through it. A procedure which is too fast, at temperatures which are too high, would here lead to damage to the web of material right up until a runaway of the reaction. A web of material which at first appearance seems very loose but is actually constructed from very thick fibres or from bundles of fibres, for example a woven fabric, layered material or knitted fabric, likewise has to be stabilised relatively slowly and at temperatures which are not too high, because here, despite good possibilities for the supply and removal of heat by the flowing gas, overheating of the inside of the fibres or bundles of fibres has to be avoided and the stabilization reactions require a certain time because of their diffusion-controlled course. By contrast, a thin web of material which has a loose fibre structure made up of thin threads and can be stabilized at a comparatively high temperature within a short time, is relatively unproblematic. With regard to the previous embodiments, it is difficult to give a preferred manner of operation. Because of the significance of the invention for high mass flow rates on webs of material, however, the method which has the shortest time for the thermal stabilization whilst retaining certain quality criteria for the web of material is always preferred.

Instead of being carried out with a gas or with a uniformly composed gas mixture, the stabilization can also be carried out with gas mixtures whose composition changes during the stabilization reaction, or an inert gas, for example nitrogen or argon, is used for one part of the reaction, and for the other part, the gas containing an oxidizing agent is used. In this way, for example, the course of the reactions involved in the stabilization can be delayed with respect to each other, in that when inert gas is used, first of all the dehydrogenation reactions and oxidation reactions and consequently their portions in the reaction enthalpy in the fibres are suppressed, and these reactions are reinstated in the second stage under oxidizing conditions. In the reverse case, the fibres can first of all be non-oxidized and loaded with oxygen under oxidizing conditions and the reactions can then be completed in the intended manner using inert gas.

The temperature range within which the stabilization is generally carried out lies between 180 and 320° C., preferably between 220 and 260° C., with these temperatures being defined as the temperatures which the gas flowing through the web of material has at the flowing-in side. When the predetermined gas temperatures are used and in the case of the proper course of the reaction, the temperatures of the individual fibres in the web of material can be up to a maximum of 10 K above the temperatures of the gas flowing-in. Depending on the textile structure of the web of material, dimensions and also the shape and material composition of the fibres of the web of material, the stabilization is carried out within a period of time in the range of 0.5 to 10 hours, preferably in the range of 0.5 to 6 hours. Of course, the stabilization can also take place with substantially longer times, but the method then becomes increasingly uneconomic and the sheet structure, or its fibres, can suffer losses of quality, for example as a result of too high a take up of oxygen.

Oxygen must be present for the operation of the dehydrogenation reaction of the PAN-polymers, which forms an essential part of the stabilization process. All oxygen-yielding substances which can be converted into gaseous or vaporous form come into consideration as oxygen donors, in particular, however, molecular oxygen, ozone, sulphur trioxide, nitrogen dioxide or dinitrogen tetroxide, dinitrogen monoxide or laughing gas, and nitrogen monoxide. In general, these substances are not in pure form, even in the cases where this would be possible, but are used in a mixture with an inert carrier gas. The proportion of the substances consisting of oxygen or containing oxygen is in this case preferably 20 percent by volume, in relation to the gas mixture being equal to 100%. The particularly preferred gas mixture is air.

In order to further process the multidimensional sheet structure, the partial carbonization, the carbonization and the graphitization can be joined on to the stabilization process as additional subsequent method steps. To achieve this, one or more of these additional method steps can be carried out in equipment coupled to the oxidation unit or part of this unit. The partial carbonization is carried out in a manner which is known per se, in the temperature range from 320 to 800° C., preferably from 500 to 700° C., in an inert atmosphere. In this step of the method, which can also be carried out continuously, the carbon content of the webs of material is further raised by loss of hydrogen, oxygen and hetero-atoms, in particular of nitrogen, and the degree of cross-linking of the carbon framework in the filaments is increased. In parallel thereto, flame resistance, temperature resistance and corrosion resistance rise, whereby the flexibility of the fibres in the web of material is retained to a considerable extent. Partially carbonized webs of material can be used for flame retardant textiles, insulating linings, as a filter material or for the production of composite materials, for example.

Carbonization can follow the partial carbonization and is carried out in an inert atmosphere in the temperature range from 800 to 1800° C., preferably from 800 to 1400° C. In this process, which can also be carried out continuously, the fibres which form the multidimensional sheet structure are completely converted into carbon. Such multidimensional sheet structures can be used under protective gas up to the highest temperatures. They are extremely corrosion resistant and have a comparatively high electrical resistance. For this reason, they can be used, for example, as a filter material or as a substrate material for catalytic or electrochemical uses. Felts produced in this way can also be used, for example, as a high-temperature insulating material in a non-oxidizing atmosphere because of their heat insulating properties. The main area of use of carbonized webs of material is, however, the production of composite materials, in particular composite materials having a synthetic resin matrix or carbon matrix.

The last thermal refining stage to which the multidimensional sheet structures produced according to the method in accordance with the invention can be subjected is graphitization, which is carried out in an inert atmosphere in the temperature range of 1800 to about 3000° C., preferably in the region above 2000° C. This method step can also be carried out continuously, for example with equipment according to German Utility Model 72 31 623.

Each of the multidimensional sheet structures produced according to one of the methods described is suitable for producing composite materials of the widest variety of types. By selecting the web of material—matrix combination which is suitable in each case, it is possible to produce, in combination with appropriate further processing steps and/or refining steps, such as carbonization, graphitization, impregnation, coating, siliconizing, or activation for example, materials which are targeted on a plurality of uses.

The method described has the following advantages:

In the production of multidimensional sheet structures consisting of thermally stabilized PAN-based fibres, the roundabout route which has hitherto been necessary, of first thermally stabilizing PAN-fibres, and then processing these thermally stabilized fibres—which in comparison with the non-stabilized fibres made of PAN are considerably more rigid and therefore more mechanically sensitive and more difficult to process in terms of textiles—to form webs of material, is done away with. This advantage is particularly large where, for the further processing, as happens for example in the production of felts, the fibres have to be crimped and/or processed to form staple fibres before webs of material are produced therefrom. Webs of material made of PAN-fibres can now be directly thermally stabilized.

With this procedure it is advantageous that the production of multidimensional sheet structures made of PAN-fibres is unproblematic and the latter are therefore commercially available in a plurality of qualities.

The method can be carried out continuously. As a result of this, it is possible to produce in a more economic way thermally stabilised PAN-based webs of material which have a more homogeneous distribution of their material properties and are therefore qualitatively better.

The more homogeneous distribution of the material properties results in processing advantages in the further processing of the webs of material, in particular in the partial carbonization, carbonization and graphitization. The webs of material obtained according to these processing stages are likewise of improved quality.

First of all the apparatus for establishing the parameters by means of which the method is controlled in a continuous procedure, and afterwards the equipment for the continuous thermal stabilization of PAN-fibre-based multidimensional sheet structures are described in the following by way of example.

Figure 1:
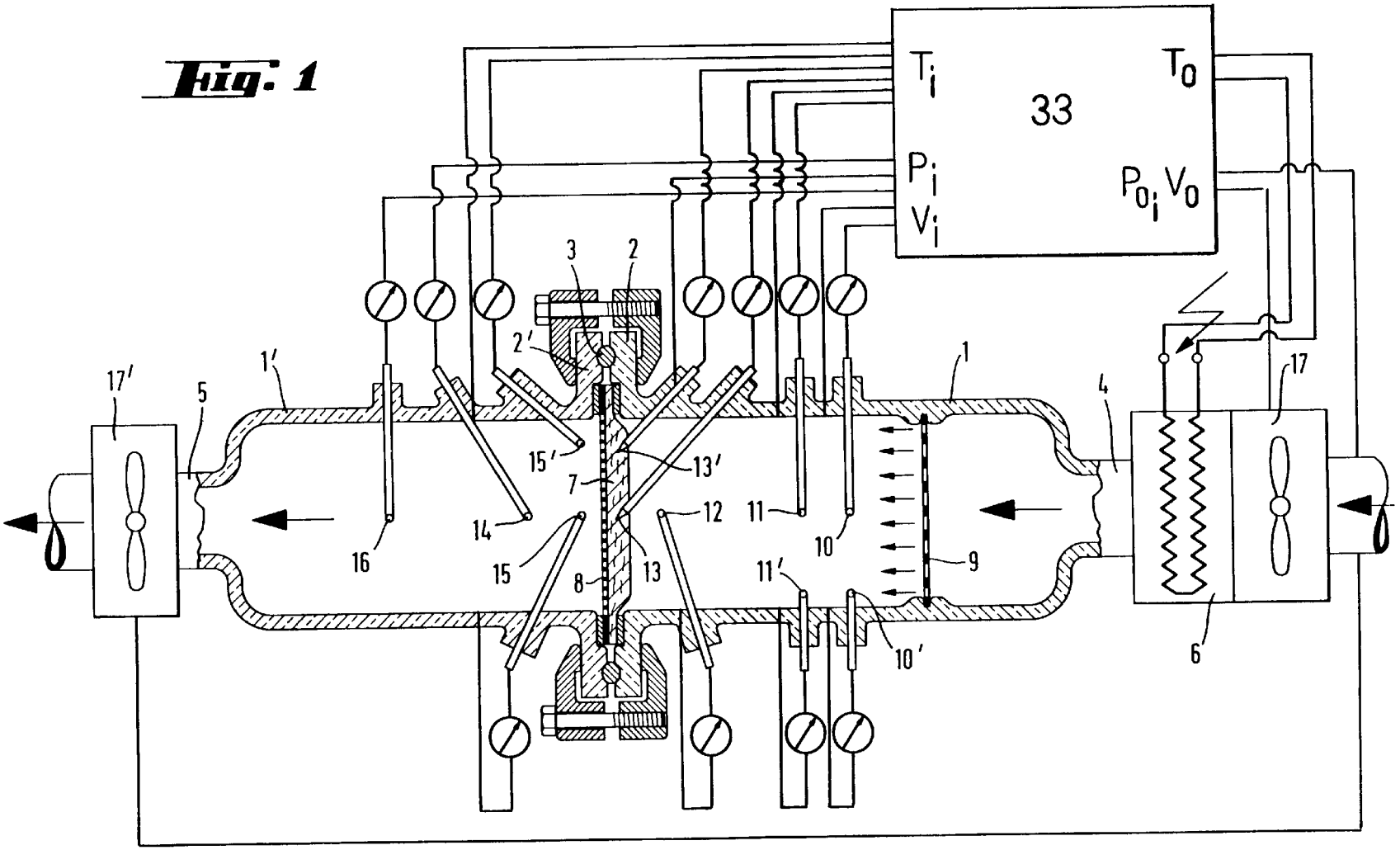
FIG. 1 is a diagrammatic view of apparatus, according to the present invention.

FIG. 1 shows, in a diagrammatic reproduction, a flow tube which consists of two tube parts 1, 1' and has an inside diameter of, for example, 12 cm and is made of an apparatus glass (Duran) which is resistant to temperature and to changes in temperature. Each of the tube parts 1, 1' has on the side which faces the centre of the flow tube a flange 2, 2', with the aid of which the two tube parts 1, 1' have been clamped together with known means to form the flow tube. A graphite seal, or temperature resistant PTFE-seal 3 is clamped between the flanges 2, 2' as a seal. At the other end of the tube parts 1, 1' are the supply element 4 (tube part 1) and removal element 5 (tube part 1') (not represented in greater detail) for the gas which flows through the tube. On the gas-supply side there are, in addition, a conveying device 17, heating device 6 and control device (which are reproduced only in a diagrammatic manner) for the gas current. In the centre of the flow tube, a disc 7 made of the web of material which is to be tested, together with a comparatively wide-meshed net 8 formed from thin wire made of chromium-nickel steel (mesh width 3 to 5 mm, wire thickness about 0.2 mm) is clamped in the flange region between the flanges 2, 2', with interpositioning of two rings made of commercially available flexible graphite. The wire net 8 supports the web of material 7 and prevents it from sagging at comparatively high flow pressures. In order for the gas which enters in the tube part 1 at the entrance 4 to be distributed evenly over the cross-section of the flow tube, there is mounted in the first third of the tube part 1 a perforated plate 9. In order to measure the values for the temperature, the flow velocity and the gas pressure, the following measurement locations are accommodated in the flow tube:

two positions for measuring the flow velocity in the approach flow region in the partial tube 1, the positioning being in the centre of the tube 10 and close to the wall 10';

two positions for measuring the temperature in the approach flow region in the partial tube 1, the positions being in the centre of the tube 11 and close to the wall 11';

one position for measuring the gas pressure 12 in the approach flow region;

two positions for measuring the temperature in the web of material or directly thereon, the positions being in the centre 13 and in the region of the edge 13';

one position for measuring the gas pressure 14 in the out-flow region behind the web of material;

two positions for measuring the temperature in the out-flow region, one position being in the centre of the tube 15 and the other being close to the wall 15';

one position for measuring the flow velocity 16 in the out-flow region.

At the end of the discharge region of the apparatus, after a gas-cooling section which is not shown, there is a ventilator 17', which can be controlled in terms of its speed and by means of which a differential pressure can be deliberately regulated with respect to the pressure in the approach flow region in order to improve the through-flow of the web of material in the out-flow region.

Figure 2:
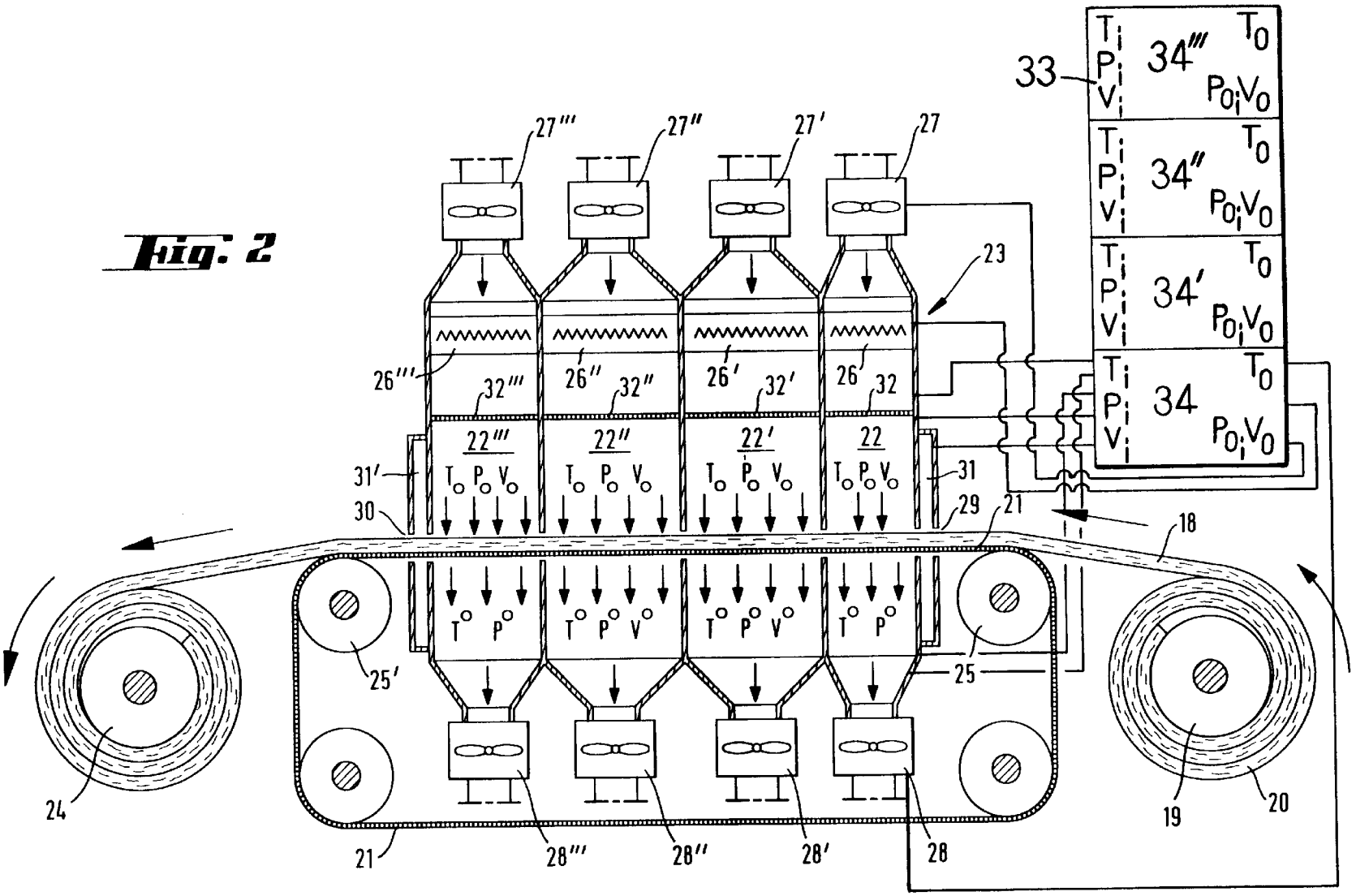
FIG. 2 is a diagrammatic view of apparatus for continuous thermal stabilization of PAN-fibre-based multidimensional sheet structures.

FIG. 2 reproduces, in a diagrammatic representation which is not true to scale, a unit for the continuous thermal stabilization of PAN-fibre-based multidimensional sheet structures. A web of material 18 is unwound from a web roller 20 located on an unwinding unit 19, is transported on a lattice 21, preferably a wire lattice made of thin wires and having meshes of large clear openings, through a furnace 23 consisting of at least one spacious section 22 in which the conditions for the thermal stabilization are maintained, and after leaving the furnace 23 is wound up on a take-up device 24. Advantageously, the lattice 21 is moved synchronously with the web of material 18 through the furnace 23. For this purpose, it rotates as an endless strip with the aid of driven rollers 25, 25'. In this connection, it is also possible to proceed according to another known method. When passing through the furnace 23, something which takes place during a certain predetermined time, a certain amount of gas flows through the web of material 18, the amount of gas being matched to the respective stabilization task and the gas having a predetermined composition and temperature. In order to detect and regulate the temperature ratios and flow ratios in the furnace 23, there are installed in the approach flow region above the web of material 18 and in the out flow region beneath the web of material measurement positions for the temperature (T), for the gas pressure (p) and for the flow velocity (v). The heating elements 26 are controlled for tempering the approaching gas flowing in, the ventilators 27 in the approach flow region are controlled for producing the desired gas flow and the ventilators 28 in the out-flow region are controlled for removing the gases from the flowing-off region and for maintaining the differential pressure required for an effective through-flow of the web of material 18, as a result of the values measured at these positions by way of appropriately connected control loops. In order to produce a gas flow which is uniform over the cross-section of the respective section 22, 22', 22", 22''' of the furnace 23, gratings or perforated plates 32 are provided. In the case of thermal stabilizations which are uncritical, for example in the case of comparatively thin webs of material which can flow through easily, the ventilators 28 in the out-flow region can even be omitted. The measurement of the gas temperatures in the approach flow region and in the out-flow region is used to determine the temperature ratios in the web of material and permits important conclusions as to the correct reaction path and the quality of the web of material. With isothermal operation with a gas having a constant composition, the division of the furnace 23 into sections 22, 22', 22", 22''' can be omitted. If, however, the stabilization reaction is to be carried out using certain temperature gradients or with gases having a varying composition, the furnace must be divided into sections 22, in which the process parameters can be controlled independently of those of the other sections 22. The total of four sections 22, 22', 22", 22"' is here given only by way of example. Depending on process-control requirements, the unit can also contain fewer or more sections 22. Because the web of material 18 is always moved through the furnace with constant speed, the period of residence of the web of material 18 in the individual sections 22 has to be controlled by the extent, i.e. the width, of the sections 22 in the direction of motion of the web of material 18. Mixtures of the gas currents of chambers 22 which are adjacent and adjusted to equal pressure levels, are, besides a downward extent of the separating walls of the sections 22 up to close to the web of material, avoided by maintaining a low pressure in the out-flow chambers that is slight in comparison with the pressure in the approach flow chambers. The gas pressures in the approach flow chambers should not differ too greatly from each other. Gases which may emerge at the entrance 29 to the furnace or the exit 30 from the furnace are collected in the coffers 31, 31' located there and are suctioned off.

FIGS. 1 and 2 illustrate a continuously operating control unit 33 with individual parts 34, 34', 34", and 34"' controlling the furnace sections 22, 22', 22", and 22"', respectively. Continuously operating control unit 33 is connected with the measuring devices receiving the measured values of the devices and (1) connected with the heating installations 26, 26', 26", and 26"' to control them for tempering gas flowing in, and (2) connected with the fans 27, 27', 27" and 27"' in the gas flowing inside of the chamber-like sections 22, 22', 22", and 22"' controlling them for producing a desired gas flow into the multidimensional sheet structure 18.

The invention is explained in greater detail in the following with the aid of exemplifying embodiments, which are reproduced in the forms of test summaries in Tables 1, 2 and 3.

All tests for the thermal stabilization were carried out either with commercial felts, which were produced from PAN-fibres Dolanite®10, or with woven fabrics produced from Dolan®25-based PAN-fibres or Dolanite®12-based PAN-fibres, in a technical apparatus according to FIG. 1, with air as the flowing gas. The thermally stabilized multidimensional sheet structures which were obtained in this way were subsequently carbonized under uniformly inert conditions in a shaft furnace with a maximum temperature gradient of 10 K/h for 5 days. In Tables 1, 2 and 3, the data characterizing the starting material (PAN-felt or PAN-woven fabric) are given at the top, after that the temperature/time conditions under which the thermal stabilization was carried out, and then some characterising data for the thermally stabilized sheet structures. Conclusions can be drawn from the tests that show that the multidimensional sheet structures which were thermally stabilized according to the method can be refined further by subsequently connected method steps, for example by carbonization.

The test results show that using various method conditions, PAN-based webs of material of various qualities can be thermally stabilized according to the above-described method. It can be further inferred from the test results that the properties of the stabilized webs of material which are produced can be influenced by selecting the method conditions in the thermal stabilization. This proves that with the method in accordance with the invention, it is possible, after carrying out simple pre-tests, to target multidimensional sheet structures consisting of thermally treated PAN-fibres that have predetermined properties.

TABLE 1

| Test No. | 1 | 2 | 3 | 4 |
|---|---|---|---|---|
| Type of Material: PAN-felt raw state | | | | |
| thickness[1] (mm) | 10.8 | 45 | 14 | 7 |
| weight per unit area[2] ($g/m^2$) | 950 | 3800 | 800 | 1000 |
| bulk density[3] ($g/cm^3$) | 0.0880 | 0.0844 | 0.0571 | 0.1422 |
| Thermal Stabilization | | | | |
| time (h) | 6 | 6 | 7 | 4 |
| temperature (° C.) | 223 isothermal | 230 isothermal | 230 isothermal | 244 isothermal |
| Therm. Stabilized Felt | | | | |
| thickness[1] (mm) | 10.0 | 38 | 11.3 | 5.5 |
| weight per unit area[2] ($g/m^2$) | 1423 | 5620 | 1200 | 1590 |
| bulk density[3] ($g/cm^3$) | 0.1423 | 0.1479 | 0.1062 | 0.2890 |
| density[4] ($g/m^3$) | 1.344 | 1.360 | 1.390 | 1.411 |
| Carbonized Felt | | | | |
| carbonization temp (° C.) | 1000 | 1000 | 1000 | 1000 |
| carbon yield[6] (%) | 52.1 | 51.3 | 52.6 | 54.5 |
| thickness[1] (mm) | 8.2 | 32 | 10.3 | 4.9 |
| weight per unit area[2] ($g/m^2$) | 1011 | 3985 | 630 | 1025 |
| bulk density[3] ($g/cm^3$) | 0.1233 | 0.1245 | 0.061 | 0.2092 |

Process specifications according to which the values given in Tables 1, 2 and 3 were established:
[1]Thickness: DIN 53855, part 2, measuring surface 20 $cm^2$
[2]Weight per unit area DIN/ISO 536, measuring surface 100 $cm^2$
[3]Bulk density = density of the porous felt body, calculated from [1] and [2]
[4]Density: DIN 29971/DIN 65 569, part I
[5]Specific electrical resistance: DIN 51911
[6]Carbon yield: residue of a thermally stabilized felt treated with protective gas up to a final temperature of 1000° C.

TABLE 2

| Test No. | 5 | 6 | 7 | 8 |
|---|---|---|---|---|
| Type of Material: PAN-felt raw state | | | | |
| thickness[1] (mm) | 7 | 7 | 15 | 15 |
| weight per unit area[2] ($g/m^2$) | 1000 | 1000 | 740 | 740 |
| bulk density[3] ($g/m^3$) | 0.1422 | 0.1422 | 0.0493 | 0.0493 |
| Thermal Stabilization | | | | |
| time (h) | 4 | 2 | 2 | 2 |
| temperature (° C.) | 230.–240 rising | 230.–240 rising | 260.–245 falling | 250.–245 falling |
| Therm. Stabilized Felt | | | | |
| thickness[1] (mm) | 5.5 | 6.0 | 13 | 13.6 |
| weight per unit area[2] ($g/m^2$) | 1500 | 1395 | 1150 | 1090 |
| bulk density[3] ($g/cm^3$) | 0.2727 | 0.2325 | 0.089 | 0.080 |
| density[4] ($g/cm^3$) | 1.386 | 1.302 | 1.380 | 1.332 |
| Carbonized Felt | | | | |
| carbonisation temp (° C.) | 1000 | H1000 | 1000 | 1000 |
| carbon yield[6] (%) | 54.2 | 49.4 | 51.7 | 50.2 |
| thickness[1] (mm) | 4.8 | 4.3 | 9.5 | 9 |
| weight per unit area[2] ($g/m^2$) | 1027 | 1070 | 820 | 925 |
| bulk density[3] ($g/cm^3$) | 0.2140 | 0.2498 | 0.086 | 0.103 |

TABLE 3

| Test No. | 9 | 10 |
|---|---|---|
| Type of Material: PAN-woven fabric made from staple-fibre yarn (staple fibres: length 40 mm, 1:7 dtex) | | |
| PAN - Type | Dolan 25 | Dolanite 12 |
| weight per unit area[2)] ($g/m^2$) | 290 | 120 |
| density[4)] ($g/cm^3$) | 1.18 | 1.18 |
| Thermal Stabilization | | |
| time (h) | 6 | 4 |
| temperature (° C.) | 235 isothermal | 245 isothermal |
| Therm. Stabilized Woven Fabric | | |
| weight per unit area[2)] ($g/m^2$) | 400 | 170 |
| density[4)] ($g/cm^3$) | 1.37 | 1.395 |
| Carbonized Woven Fabric | | |
| Carbonization temperature (° C.) | 1000 | 1000 |
| carbon yield[6)] (%) | 50.5 | 53.9 |
| weight per unit area[2)] ($g/m^2$) | 305 | 132 |

We claim:

1. A device for the continuous thermal treatment of multidimensional sheet structures consisting of fibers made of polyacrylonitrile or substantially of polyacrylonitrile comprising an unwinding device for unwinding a multidimensional sheet structure consisting of fibers and a take-up device for winding up of the sheet structure, a gas-permeable transport track for the multidimensional sheet structure arranged between the unwinding device and the take-up device, a furnace arranged around a portion of the transport track for the multidimensional sheet structure and positioned between the unwinding device and the take-up device through which furnace the multidimensional sheet structure is transported on the transport track, the furnace having chamber-like sections through which sections the multidimensional sheet structure is transported, walls separating the chamber-like sections downwardly extending to the multidimensional sheet structure, channels connected with the furnace on a gas flowing in side of the chamber-like sections and conduits connected with the furnace on a gas flowing out side of the chamber-like sections for supplying gases to and carrying gases from each of the chamber-like sections of the furnace, fans arranged in each channel for conveying gases through the chamber-like sections, heating installations mounted in each channel at the flowing in side of each chamber-like section by means of which the gases flowing through the chamber-like sections are heated in a controlled manner, means in the flowing in side of the chamber-like sections of the furnace to secure that the heated gases flow evenly as possible towards the multidimensional sheet structure in a perpendicular direction through the surface of the multidimensional sheet structure, measuring devices in the chamber-like sections for measuring the temperature and the flow condition of the flow of the gas arranged at least in front of the multidimensional sheet structure and aligned in the direction of the gas flow, and a continuously operating control unit connected with the measuring devices receiving the measured values of the devices and (1) connected with the heating installations to control them for tempering gas flowing in, and (2) connected with the fans in the gas flowing in side of the chamber-like sections controlling them for producing a desired gas flow into the multidimensional sheet structure to thereby maintain a desired course of the temperature and gas flow in the multidimensional sheet structure while transported through the furnace.

2. A device according to claim 1 wherein the measuring devices for measuring the gas temperature and the condition of the flow of the gas are arranged in the chamber-like sections of the furnace above and below the multidimensional sheet structure.

3. A device according to claim 1 including fans arranged in each conduit for conveying gases through the chamber-like sections, and wherein the operating control unit is connected with the fans in each conduit controlling them for maintaining a differential pressure required for effective flow through the multidimensional sheet structure.

4. A device according to claim 2 including fans arranged in each conduit for conveying gases through the chamber-like sections, and wherein the operating control unit is connected with the fans in each conduit controlling them for maintaining a differential pressure required for effective flow through the multidimensional sheet structure.

5. A device according to claim 1 wherein each chamber-like section has one channel on the gas flowing in side and one conduit on the gas flowing out side for supplying gases to and carrying off gases from the chamber-like sections whereby each channel and each conduit is separated from the channels and conduits of adjacent chamber-like sections.

6. A device according to claim 1 including means connected with each channel on the flowing in side of the chamber-like sections to supply the sections with uniformly composed gas mixtures composed of an inert gas and an oxidizing agent.

* * * * *

UNITED STATES PATENT AND TRADEMARK OFFICE

CERTIFICATE OF CORRECTION

PATENT NO. : 5,967,770

DATED : October 19,1999

INVENTOR(S) : Michael Heine et al.

It is certified that error appears in the above-identified patent and that said Letters Patent is hereby corrected as shown below:

Column 10, line 23 (in Table 1), "density $^{4)}$(g/m$^3$)" should read – density $^{4)}$(g/cm$^3$) –.

Column 10, line 49 (in Table 2), "bulk density $^{3)}$(g/m$^3$)" should read – density $^{4)}$(g/cm$^3$) –.

Signed and Sealed this

Ninth Day of May, 2000

*Attest:*

Q. TODD DICKINSON

*Attesting Officer*

*Director of Patents and Trademarks*